United States Patent [19]

Goudeaux et al.

[11] Patent Number: 4,689,923

[45] Date of Patent: Sep. 1, 1987

[54] SLURRY SANDBLASTING SYSTEM

[76] Inventors: James L. Goudeaux, 450 Vitrano La., Independence, La. 70443; Eric J. Olivier, 1406 Hwy. 311, Schriever, La. 70395

[21] Appl. No.: 731,670

[22] Filed: May 7, 1985

[30] Foreign Application Priority Data

Jul. 29, 1985 [WO] PCT Int'l Appl. ..... PCT/US85/01417

[51] Int. Cl.[4] ..... B24C 3/02

[52] U.S. Cl. ..... 51/410; 51/436

[58] Field of Search ..... 51/410, 428, 436, 439, 51/319-321; 137/565, 605; 406/94, 95, 47, 48

[56] References Cited

U.S. PATENT DOCUMENTS

| | | | |
|---|---|---|---|
| 1,202,088 | 10/1916 | Murray | 406/94 |
| 1,814,616 | 7/1931 | Boesger | 51/438 |
| 2,380,738 | 7/1945 | Eppler | 51/321 |
| 4,048,757 | 9/1977 | Kubus et al. | 51/436 |
| 4,517,774 | 5/1985 | Dudding | 51/436 |

FOREIGN PATENT DOCUMENTS

| | | | |
|---|---|---|---|
| 0086616 | 8/1983 | European Pat. Off. | 51/410 |
| 2038750 | 7/1980 | United Kingdom . | |

*Primary Examiner*—Frederick R. Schmidt
*Assistant Examiner*—Robert O. Rose
*Attorney, Agent, or Firm*—Pravel, Gambrell, Hewitt, Kimball & Krieger

[57] ABSTRACT

A tank for receiving water thereinto, a chemical injector for injecting a measured amount of chemical inhibitor into the water in the tank, a pump placed atop the tank for providing water mixed with the inhibitor chemical under pressure out of the tank for injection into the sandblasting line. There is further provided an air supply for providing pressurized air to operate the pump under a certain pressure and to operate the chemical injector at a certain pressure, there being pressure regulator gauges for regulating same. The system would further comprise a sand pot also providing pressurized sand into the main sandblasting line, wherein compressed air in the system and the chemical injected water feed into the line for providing a continuous source of sand or sand slurry sandblasting under pressure. In this improved system, there is further provided a connector member contained within the sandblasting line for delivering the sand, air and water slurry to the end point or nozzle for use in the actual sandblasting.

1 Claim, 9 Drawing Figures

SLURRY SANDBLASTING SYSTEM

BACKGROUND OF THE INVENTION

1. Technical Field

The system of the present invention relates to sandblasting. More particularly, the present invention relates to a novel system for dry or wet sandblasting providing continuous air lift support for the blasting stream of air, water and sand and having a minimum of pollutant material in the atmosphere during the sandblasting operation.

2. General Background

At the present time, there are numerous systems wherein sandblasting equipment is utilized to provide a blasting stream of air and sand yet undesireable dispersion of sand and dust from the object being cleaned into the atmosphere in the vicinity of the equipment. The various methods of mixing the water and sand include mixing inside of a nozzle to provide a blasting stream containing water in order to help prevent the dispersion of sand and the abrasive dust. A likewise problem that is also confronted in the art is in the sandblasting of structures such as high buildings or elevated railways. The sandblasting equipment must be placed adjacent to the area being sandblasted in view of the fact that the pressurized sand moving through the sandblasting line loses its pressurization as it continues down the line in order to achieve maximum sandblasting effects. There is an overall need for a system wherein low dispersion of sand and dust in the vicinity of the equipment being cleaned can be achieved, together with the ability to convey the pressurized sand and mixture of water and/or air to the point being sandblasted over a distance without losing the pressure behind the abrasive cleaner.

There are several patents which have been obtained addressing the problem of sandblasting equipment and the like, the most pertinent being as follows:

U.S. Pat. No. 3,271,903, issued to W. C. Gregory, entitled "Maintaining The Resistivity Of Insulating Members In Energized Electric Equipment," although addressing an invention for maintaining the resistivity of energized electric equipment in reducing the likelihood of injury from electrical shock, does disclose the use of a double tank system for adding fluids or the like to a flow such as compressed air for achieving sandblasting or the like.

U.S. Pat. No. 3,828,478, issued to E. G. Bemis entitled "Fluid-Jet-Abrasive Device And System," again teaches the use of a system for mixing fluids from a storage tank, a high presure water pump and an abrasive reservoir tank for mixing the components into a fluid flow line. Although there is addressed a mixing of the materials in the tool, there is no disclosure of a continuous feeding of compressed air or the like into the line for achieving the maximum flow as with the present invention.

U.S. Pat. No. 3,858,358, issued to J. E. Stachowiak, et al., entitled "High Pressure Liquid And Abrasive Cleaning Apparatus," provides a high velocity, high pressure blasting system that cleans an object without polluting the atmosphere. There is included a blasting gun having a blasting nozzle for directing outwardly therefrom a low velocity stream of air abrasive mixture and a high velocity stream of water. The control means for controlling the flow of liquid and gas abrasive mixture is provided.

U.S. Pat. No. 3,994,097, issued to R. W. Lamb, entitled "Abrasive Or Sand Blast Apparatus And Method," discloses a nozzle assembly formed from a housing which is a water nozzle positioned in the rear wall having an orifice designed to produce a gradually diverging water jet in the housing when pressurized water is added to it.

U.S. Pat. No. 3,769,753, issued to H. Fleischer entitled "Automatic Car Sand Blaster," was included in the search since it did relate to the pre-mixing of the materials just prior to release of the mixture by the gun. U.S. Pat. Nos. 3,972,150; 3,103,765; 3,584,481; 3,343,304; 4,330,968; and 4,319,435 are all systems directed toward pressure water sandblasting or slurry sandblasting, and although are part of the art, are not as pertinent as the previous art.

SUMMARY OF THE PRESENT INVENTION

The system of the present invention would introduce a novel approach to sandblasting through a combination of components in the system. What is provided is a tank for receiving water thereinto, a chemical injector for injecting a measured amount of chemical dust inhibitor into the water in the tank, a pump placed atop the tank for providing water mixed with the inhibitor chemical under pressure out of the tank for injection into the sandblasting line. There is further provided an air supply for providing pressurized air to operate the pump under a certain pressure and to operate the chemical injector at a certain pressure, there being pressure regulator guages for regulating same. The system would further comprise a sand pot also providing sand into the main sandblasting line, wherein compressed air in the system and the chemical injected water feed into the line for providing a continuous source of sand or sand slurry sandblasting under pressure. In this improved system, there is further provided means contained within the sandblasting line for delivering the sand, air and water slurry to the end point or nozzle for use in the actual sandblasting. This means would further comprise an injection of pressurized air into the main line at 50 foot or greater, depending on the circumstances, intervals on the line wherein there are provided a means for regulating the air through an orifice check valve for ensuring a continuous amount of pressure of air despite the pressure of air in the line itself. There is further provided a modified T-coupling to allow regulated introduction of air and water into the main sand line at point of origin.

An additional embodiment of the system of the present invention would comprise providing a tank of gaseous fluid under pressure, such as nitrogen, as a direct source of the pressure for operating the pump and the chemical injector system. This direct use of nitrogen as a source of gas rather than compressed air, is a cleaner more direct method of insuring pressurized fluid for operating the components of the system without the utilization of an air compressor.

Therefore, it is an object of the present invention to provide a system for sandblasting which through a chemical dust inhibitor produces relatively low deflection or pollution around the area being sandblasted;

It is a further object of the present invention to provide a system of sandblasting which utilizes in intermittent injection of pressurized air and/or fluid into the sandblasting line for boosting the pressure within the line so that the in pressure of the sandblasting is maintained over a great distance;

It is a further object of the present invention to provide a system for sandblasting the system for sandblasting the system including a means for introducing an inhibitor chemical containing water and pressurized air through an orificed metered valve simultaneously into the main sand line during the sandblasting process;

It is still a further object of the invention to provide a system for sandblasting wherein the sand may be essentially dry or in a slurry form depending on the circumstances of the sandblasting;

It is still a further object of the present invention to provide a system for sandblasting wherein the chemical inhibitor included in the sandblasting slurry could be shutoff thus producing a non-chemical containing inhibitor slurry for more benign sandblasting tasks;

It is still a further object of the present invention to provide an additional embodiment for a system of sandblasting which would provide pressurization from nitrogen or the like gas under pressure for providing a cleaner carrier for pressurized gas in the system.

In order to achieve the above objects of the present invention, it is a feature of the present invention to provide a system of pressurized air for driving a water pump and chemical injector for further providing the pressurized water into the water sandblasting line as regulated;

It is a further feature of the present invention to provide air injection points along the sandblasting line to provide a continuous means for driving the sand under pressure through the line to the end point nozzle;

It is still a further feature of the present invention to provide means for shutting down the system at the starting point of the system should there be a problem arise in the sandblasting activity itself.

BRIEF DESCRIPTION OF THE DRAWINGS

For further understanding of the nature and objects of the present invention, reference should be had to the following detailed description, taken in conjunction with the accompanying drawing in which the parts are given like reference numerals and wherein.

DETAILED DESCRIPTION OF THE PRFERRED EMBODIMENT

Figure 1:
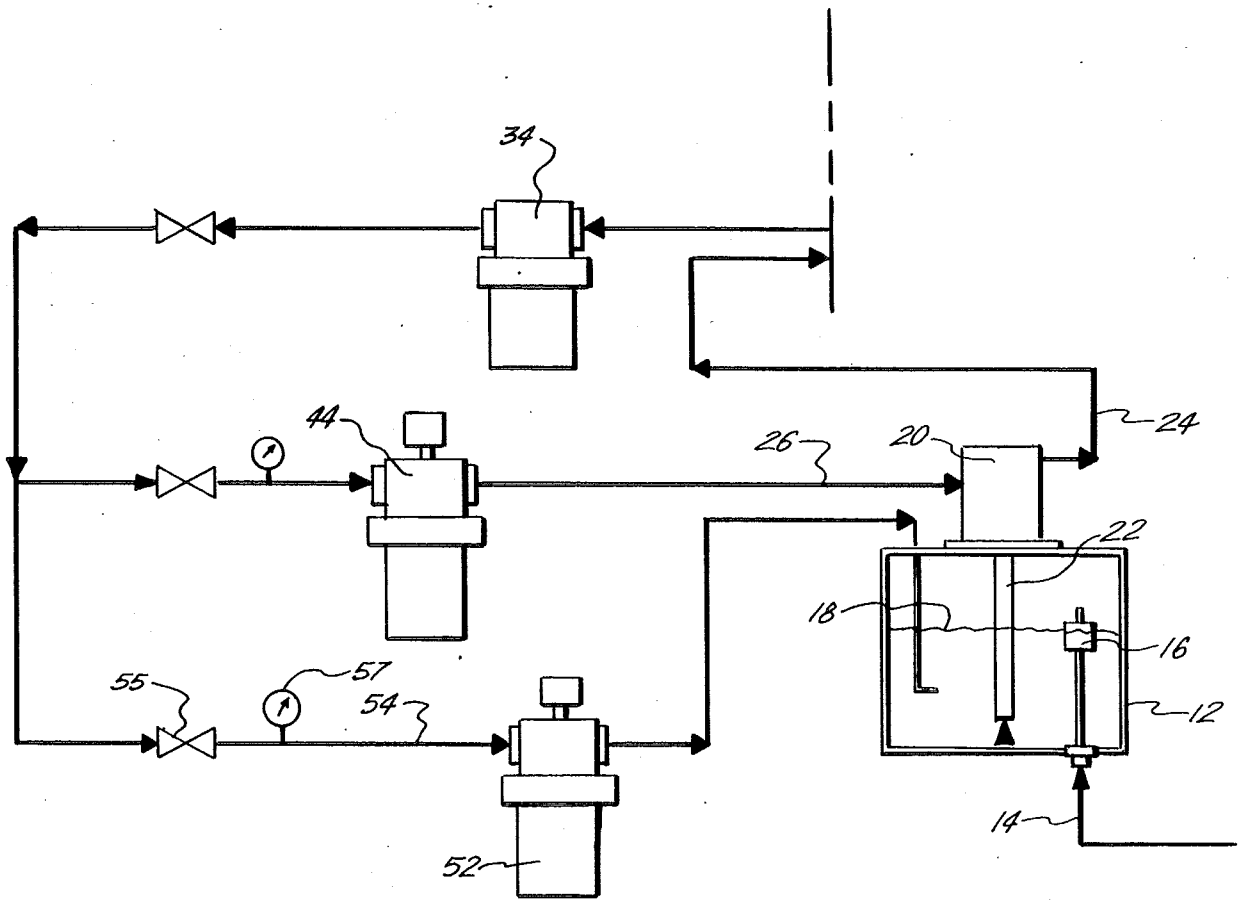
FIGS. 1 and 2 are overall views of the preferred embodiment of the system of the present invention.
Figure 2:
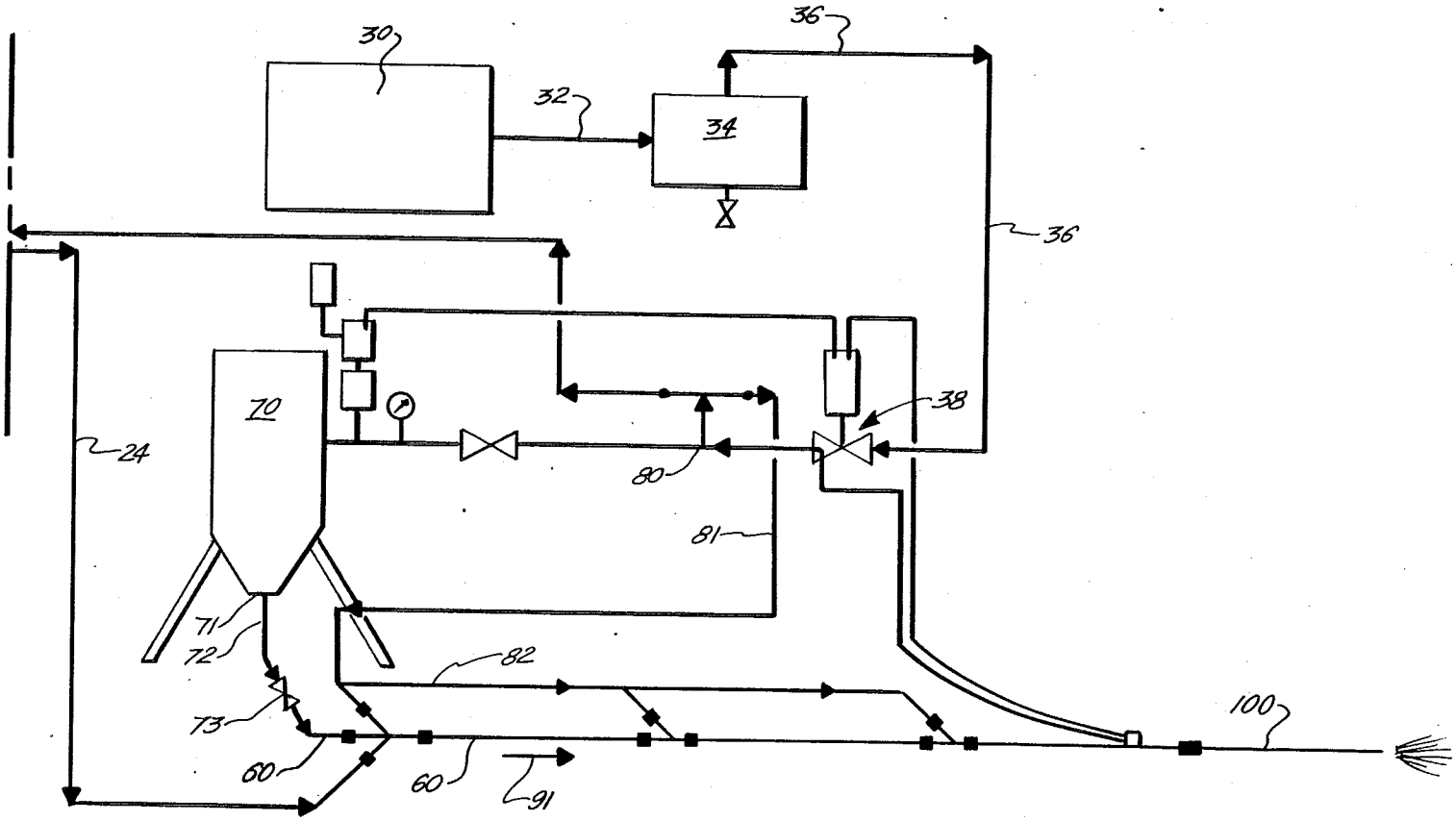

FIGS. 1–4 illustrate the preferred embodiment of the system of the present invention, with the FIGS. 1 and 2 illustrating the overall system of the present invention. The sandblasting system of the present invention would comprise, as seen in FIG. 1, a water holding tank 12 which could be a 50 gallon tank having a line 14 and a water level monitoring means 16 for maintaining the water at a constant level, i.e., level 18. There is further provided upon tank 12, as illustrated in FIG. 1, a pumping means 20 which would comprise an air driven lift pump for drawing water from tank 12 via member 22 and pumping it from pump 20 via line 24, as will be discussed further. For clarity of illustration, line 26 represents pressurized air coming into pump 20 which is the driving source behind pump 20. Pressurized air line 26 would have its source at air compressor 30, as seen in FIG. 2. Compressed air from air compressor 30 would exit air compressor 30 via line 32 to move into air dryer 34, as seen in FIG. 2.

Figure 4:
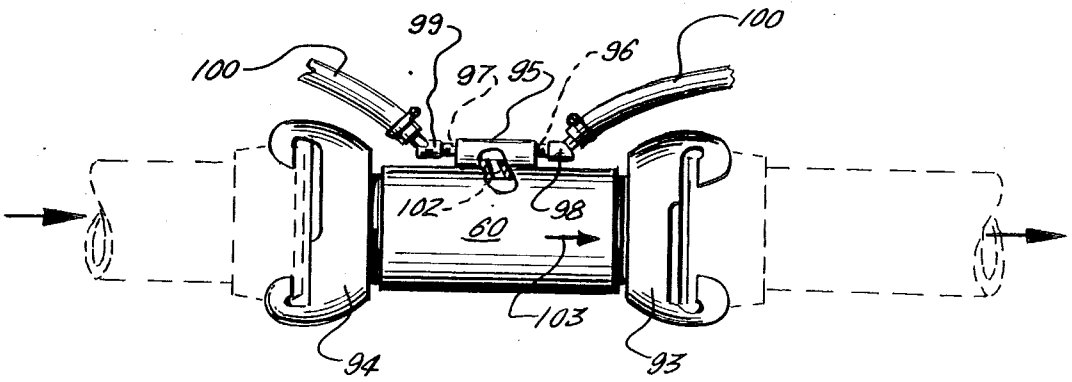
FIG. 4 is a side view of the air injection portion in the preferred embodiment of the system of the present invention.

In discussing the overall system, as seen in FIGS. 1 and 2, reference will be constantly made to FIG. 4 which is an overall perspective view of tank member 12 and the associated apparatus supported atop tank member 12 for clarity in discussion of the system. As was discussed earlier, as seen in FIG. 4, tank member 12 further illustrates pump 20 as seen in the system drawing in FIG. 1, and pipe member 22 for lifting water out of tank member 12 into pump member 24 pumping out of line 26, as also seen in FIG. 4. There is further illustrated in FIG. 4 the means 16 for regulating the water level in tank 12 as was previously discussed in FIG. 1.

Figure 3:
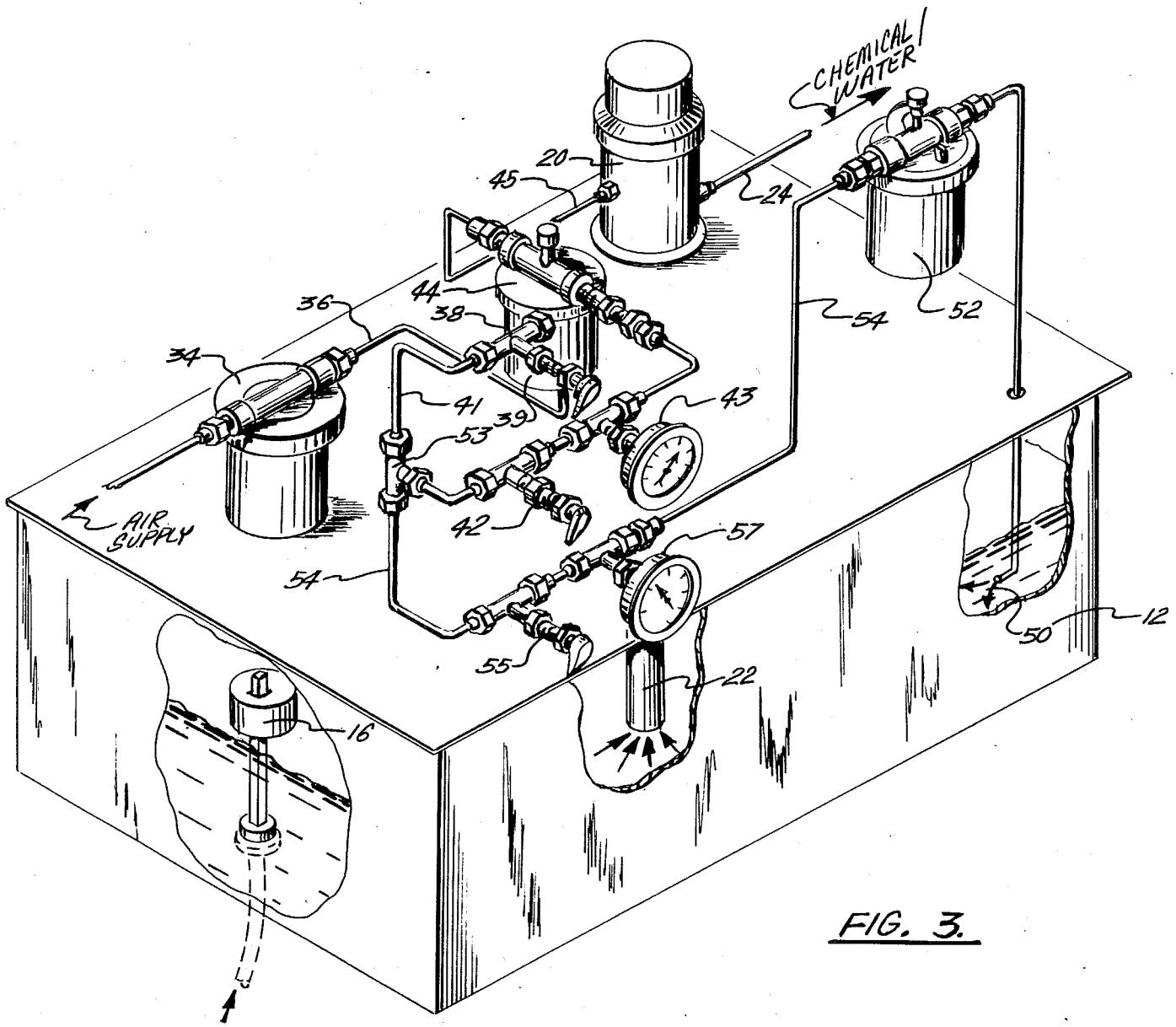
FIG. 3 is an overall perspective view of the water tank, chemical injector, and pump in the preferred embodiment of the system of the present invention.

Returning now to the flow of the pressurized air, as seen in both FIGS. 1, 2 and 3, following the pressurized air leaving dryer 34, and entering line 36, prior to the pressurized air moving into pump 20, there is further provided valve regulation means 38 which is a standard gate valve for regulating the flow of air through line 36, which would be typically a ⅛ inch O.D. line, although may vary to 1" O.D., for allowing air therethrough. As seen in FIG. 4, line 38 would form a first T 39 with one arm 41 of T 39 branching off for eventual connection into pump 20. Following the branching off of line 41, there is provided needle valve member 42 for regulating the flow within line 41 and guage 43 for indicating the amount of pressure within line 41. Prior to the air being introduced into pump 20, there is provided oiler 44 which would provide a metered amount of oil into the air for injecting via line 45 into pump 20 and maintaining a lubricated state thereinto. As was stated earlier, the pressurized air going into pump 20 would control the pumping action of pump 20 for removal of water and chemical from tank 12 into line 24.

As was discussed earlier and further seen in FIG. 3, the water within tank 12 would further comprise a chemical inhibitor which is indicated by arrows 50 being injected into the water in certain metered amounts that would be contained in container 52. For purposes of this application, the chemical inhibitor is added to the water to provide a means to reduce significantly the dust associated with sandblasting and to improve the overall environmental effects of the system. Following the branching off of air in line 41, the second portion of line 41 would go to T portion 53 into line 54 wherein there would be further provided a second needle valve 55 for regulating the flow within line 54, a guage 57 for monitoring the pressure within the line, and line 54 eventually leading to chemical injector 52 for providing pressure to operate injector 52 to inject the chemical 50 into container 12 to maintain a metered amount of chemical within the water. Therefore, all water being pumped out of container 12 would contain chemically injected water in line 24.

Figure 7A:
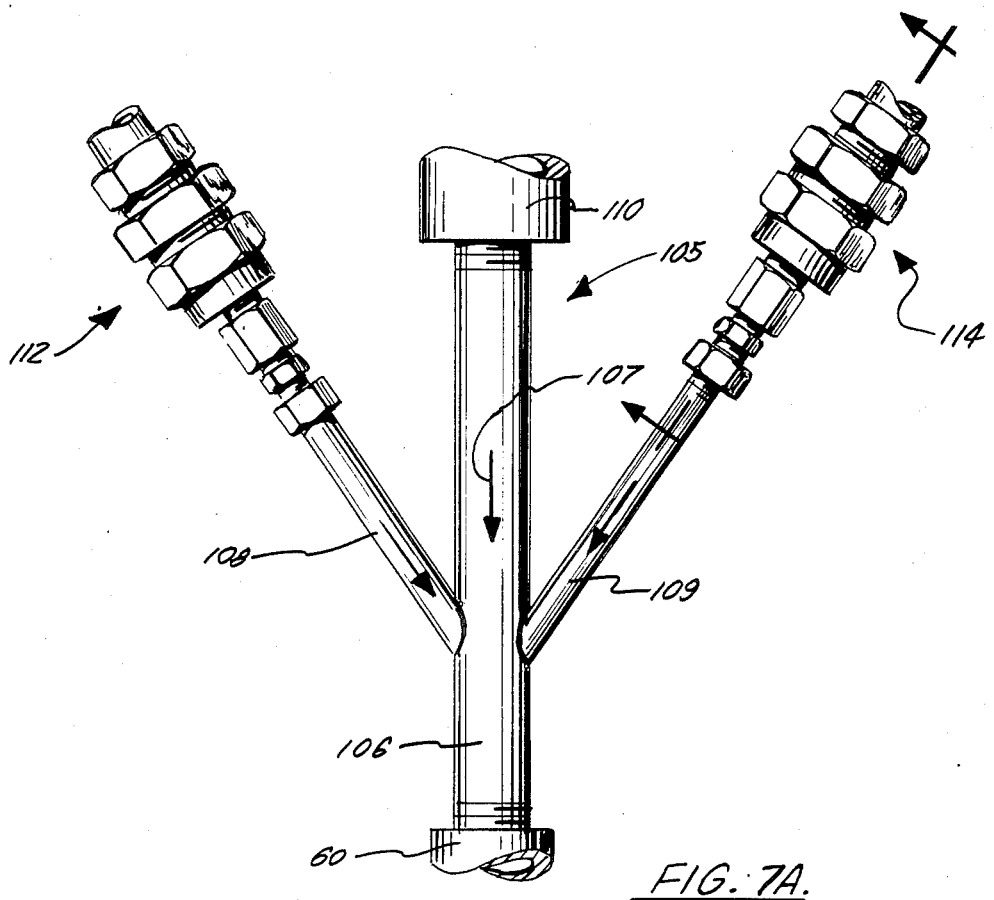
FIGS. 7A, 7B and 7C illustrate the modified T connector member in the preferred embodiment of the system of the present invention.

Returning to the system drawings of FIGS. 1 and 2, line 24, as seen in FIG. 1, would lead directly as pressurized air being of the pressure of approximately 100 PSI into principal sandblasting line 60, via modified T connector 61, as seen in FIG. 7A, the overall function and structure of which will be discussed further. Turning now our overall attention to FIG. 2, air compressor 30 in addition to providing pressurized air to pump 20, following the drying of such air in tank 34, would also provide a source of pressurized air to other items in the system. Line 36, as seen in FIG. 2, prior to the provision of pressurized air into other components, would lead into what is termed as a "dead man" valve 38 which basically would provided a means for shutting down the entire system should there be a fault in the system or problem at the nozzle end of the system, as will be discussed further. However, assuming that the "dead man" valve is in the open position, pressurized air leading into the system would initially move under pressure through line 36 into sand pot 70 which is a typical sand pot in a sandblasting system, having various types and sizes of sand depending on the work to be accomplished, wherein the air providing pressure atop the sand for moving the sand out of the bottom portion 71 of the sand pot 70 through line 72, valve 73, assuming it is in the open position, and into principal line 60 that is providing the principal source of sand in line 60.

Pressurized air within line 36, as seen in FIG. 2, while simultaneously being directed into sand pot 70, would intersect T portion 80 wherein one portion of the pressurized air would be directed via line 81 into principal sandblasting line 60 as an additional source of pressurized air into the system via connector line 82, as will be discussed further.

As seen in the system drawing in FIG. 2 and in the overall drawing in FIG. 4, one of the most novel aspects of the system is the ability of the system to maintain a constant pressurization within sandblasting line 60 between the source of the pressurized air, water and chemicals of the system components and the nozzle 100 despite the length of line 60, i.e., having the ability of the system components to be placed on the ground yet the nozzle to be hundreds of feet in the air and yet still have the type of pressure necessary to accomplish the sandblasting needed.

Figure 7B:
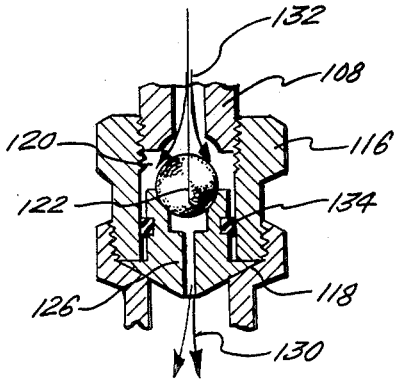
Figure 7C:
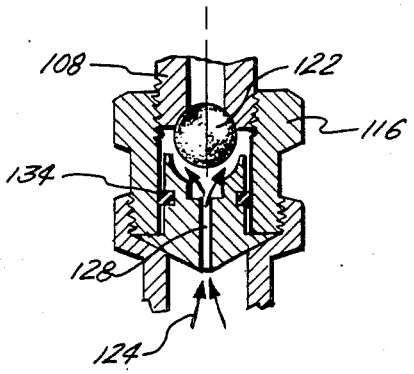

What is provided as seen in system drawing in FIG. 2, as discussed earlier, at the point that pressurized sand in sand pot 70 flows through line 72 through valve 73 into main line 60, there is initially provided a modified T connection at point 90 wherein pressurized air would enter line 60 at a 45° angle and simultaneously pressurized water and chemical would enter line 60 to create a slurry effect from that point on pressurized sand, air and water. Each line would have an orifice check valve, as seen in FIGS. 7B and 7C, as will be discussed further. It is well known that as the slurry would continue down line 60 as indicated by arrow 91, approximately 50 feet down the line the pressure would begin to drop due to the amount of slurry at that point. Therefore, as seen in FIG. 4, there is provided an insertable member 92 which would contain claw connector 93 and 94 at either end for being easily adapted to the claw-type connectors on the segments of line 60, i.e., segments A and B as seen in FIG. 4. Member 92 would provide a means for allowing pressurized air and/or water to be introduced into line 60 via double protruding portion 95 and would basically comprise an orifice member having first and second orifices 96 and 97 at either end with an adapter 98 and 99 threadably engaged into each orifice 96 and 97 wherein a gas or water line 100 can be attached thereto. As seen in partial cutaway view in FIG. 4, portion 95 would be in fluid communication with the interior of the main body portion 60 of line 60 so that any fluid flow being directed into orifice portion 95 would flow into line 60, and as seen by the angulation of port 102 in the wall of line 60, would normally flow in the direction of the flow of the sandblasting slurry as indicated by arrows 103. Therefore, with the introduction of the gas or air at this point in the line, the slurry would receive a "boost" in the pressure and maintain its pressurization throughout the flow.

Member 95 would be provided with an orifice check valve 97 which would allow only a certain metered amount of air through a particular orifice in the check valve, thus eliminating the need to regulate the pressure within the air line 98 prior to entering member 95. This pressurized air being injected via member 92 would give a boost to the slurry and any dry blast system being used at that particular juncture and would in effect increase the pressure in the line to the desired amount. Should the line need to be increased an additional 50 feet, again a second member 92 could be placed on the line and the likewise effect would be had. Due to the fact that the air pressure within the air line 81 feeding into the air injector means 92 being of unlimited pressure, an almost indefinite amount of injection points could be placed along line 60 so that an unlimited length of line 60, theoretically, could be obtained in the sandblasting system.

As further seen in FIG. 2, there is further illustrated at the end of line 60 a typical nozzle 100 as was discussed further, having a control handle 102 wherein the operator would operate having line 103 therefrom which would lead directly to "dead man" valve 38 should there be a malfunctioning in the system. The line 103 would be activated to shut off the entire system.

Figure 5:
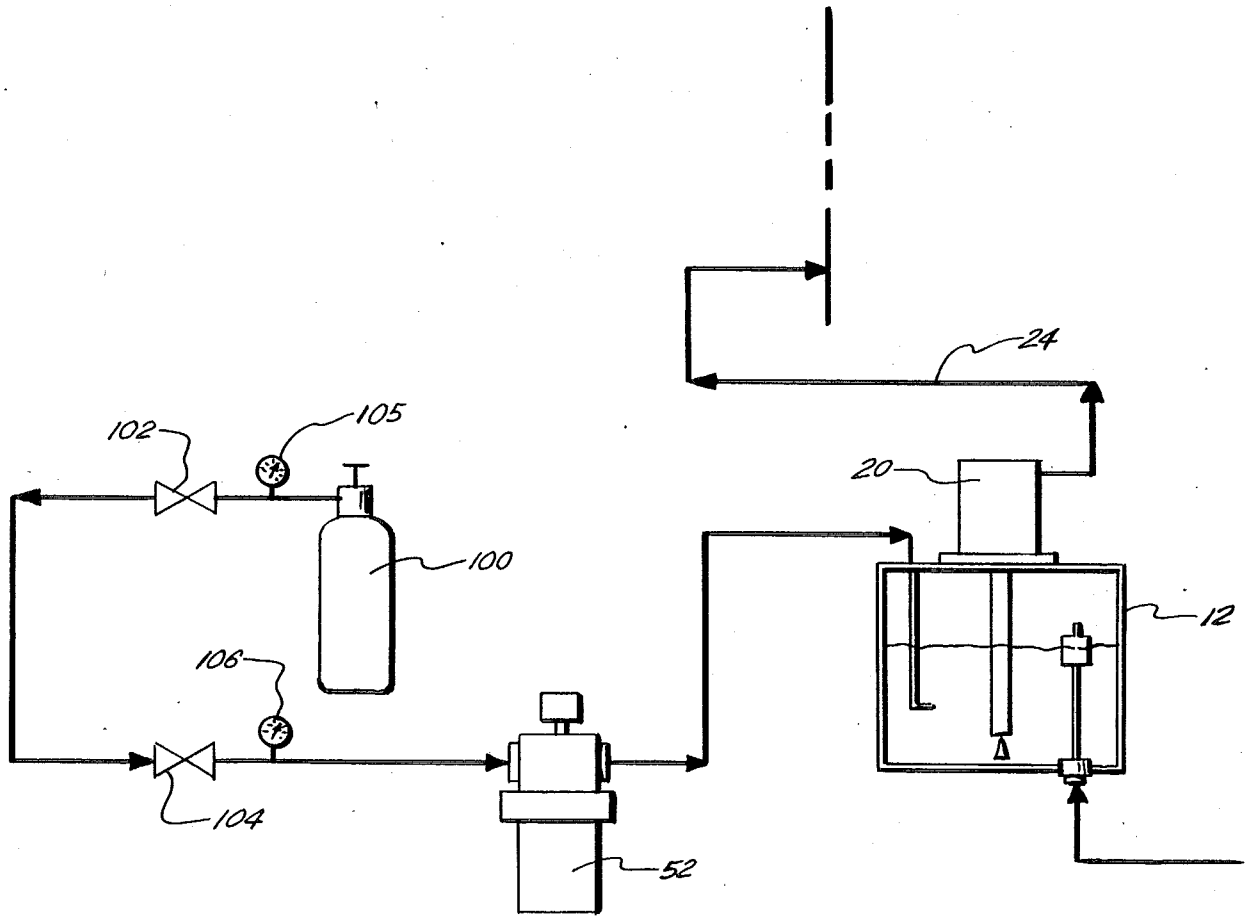
FIGS. 5 and 6 are overall views of an alternative embodiment of the system of the present invention illustrating the use of gas such as nitrogen in combination with compressed air for operation of the components in the system.
Figure 6:
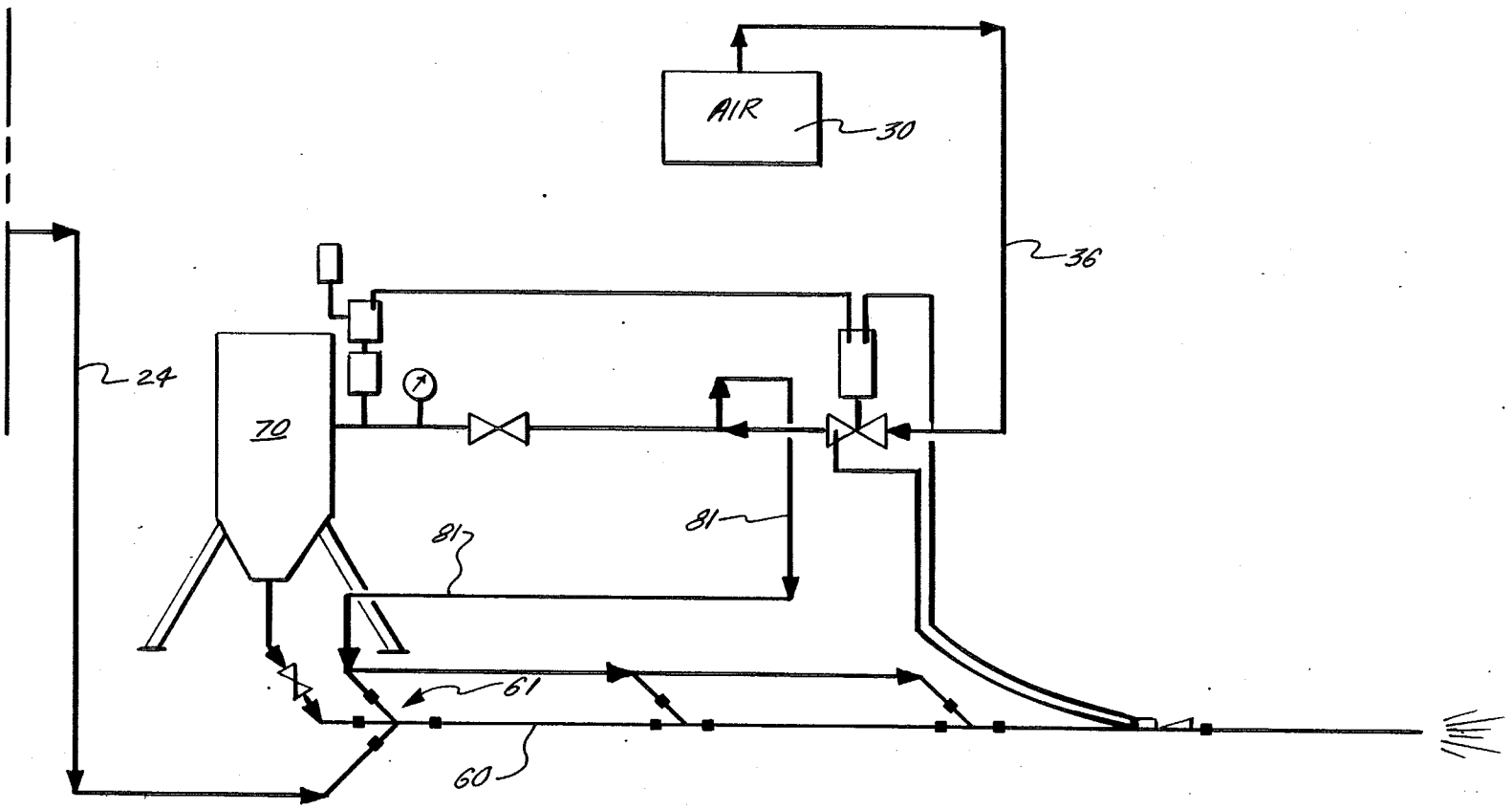

FIGS. 5 and 6 represent an additional embodiment of the system of the present invention in slurry sandblasting. What is provided in the figures as seen initially in FIG. 5 is tank portion 12 equipped with pump 20 and chemical injector 52 for injecting chemical thereinto. The system at this point would function identically to the preferred embodiment with the exception that, making reference to FIG. 1 of the preferred embodiment, the source of pressurized air to both the chemical injector and the pump has been replaced from a compressor 30 and air dryer 34 to a nitrogen or other suitable gas tank 100, as seen in FIG. 5, which has a direct linkage to both pump 20 and injector 52 in the process. With this particular embodiment, the problem with overcoming the unclean air that may occur in the compressor dryer has been eliminated and a direct measureable amount of fluid such as nitrogen gas from tank 100 can be regulated via valves 102 and 104 and gauges 105 and 106 to ascertain the quantity of pressurized fluid for operating the injector 52 in pump 20.

Likewise, FIG. 6 represents the continuation of line 24 that has the water containing chemical injector in it and flowing into the system via line 24 for direct input into principal line 60 as in the previous system. As is seen in FIG. 6, although the compressed air has been replaced in feeding fluid to injector 52 and pump 20, the compressed air, for example, air tank 30 would be utilized via line 36 into the sand pot 70 for injecting air into the sand pot. Likewise, there is also, as was seen in FIG. 1, a brahch line 81 which would feed the pressurized air as in the previous embodiment into line 60 via modified T 61, the function of which as was described earlier.

For clarification, FIGS. 7, 7A, 7B and 7C illustrate the functioning of the means for introducing the air and/or water or other fluid into principal flow line 60 as the sand flow is obtained from the sand pot 70 into main flow 60. What is provided in FIG. 7A is a portion of connector 110 which would basically connect the flow of sand from sand pot 70 to main flow line 60 a portion of which is shown on the second end of midified T portion 105. Modified T portion 105 would generally comprise a main flow portion 106 having a flow bore therethrough the direction of the flow as indicated by arrow 107, in this case pressurized sand flowing from sand pot 70 into main line 60. Main flow line 106 would further comprise a pair of converging secondary flow lines 108 and 109 which, as was described earlier, would be transporting, in the instance of 108 air under pressure, and in the instance of line 109, water containing chemical inhibitor under pressure. both lines 108 and 109 would be in fluid communciation with main flow portion 106 for introducing pressurized air and fluid into the flow of sand into main line 60. It is crucial in the description of the flow lines 108 and 109 to make reference to the orifice ball check valves 112 and 114 each of which are contained in flow line 108 and 109 respectively. Since each orifice ball check valve function identically, for instance, shall be made in FIGS. 7B and 7C to orifice ball check valve 112. As seen in FIGS. 7B and 7C in cross-section, valve 112 would comprise an outer valve housing 116 wherein the flow line 108 is threaded thereinto at its top portion. Housing 116 would also be threadably engaged on its lower portion to a lower housing 118 which would be threadably connected to the portion of line 108 being directed into principal flow line 106. Valve 112 would further comprise an enlarged central bore area 120 which would house a spherical ball 122 which would be a bearing type of metallic ball, movable within enlarged bore portion 120. Ball 120 would move between the back facing wall of line 108 and when in that position, as seen in FIG. 7C, would form a fluid tight seal in the direction of arrows 124, the function of which will be discussed further. On the forward portion, ball 122 would engage nozzle portion 126 which is also housed within main valve 112, nozzle 126 containing a metered flow bore 128 for allowing a certain amount of fluid to pass therethrough within a given amount of time in the direction of arrows 130. In the functioning, when fluid flow is in the direction of arrows 132, as seen in FIG. 7B, ball 122 is seated against the rear portion of nozzle 126, however, nozzle 126 has a series of channels 134 which allow fluid flow to pass between the wall of the ball 122 and the rear wall of nozzle 126 and continue to flow through orifice port 128 in the normal functioning. Turning now to FIG. 7C, should the flow in the direction of arrows 132 to be discontinued or blocked, and there would be a tendency to have a negative flow as seen via arrows 124, nozzle 126 would be pushed rearward and the O-ring 134 would sealingly engage the wall of the outer housing 116 of the valve and fluid flow could not pass between the wall and the wall of the nozzle. Also, the flow which would then enter bore 128 would engage ball 122 which would sealably engage the rear wall of line 108 and would likewise form a fluid tight seal. Therefore, flow would not be allowed to flow rearward and would be checked in its flow until the normal functioning would occur, as seen in FIG. 7B.

Because many varying and different embodiments may be made within the scope of the inventive concept herein taught, and because many modifications may be made in the embodiment of the law, it is to be understood that the details herein are to be interpreted as illustrative and not in a limiting sense.

What is claimed as invention is:

1. An apparatus for sandblasting while maintaining consistent pressure in the sandblasting line, the apparatus comprising:

a. a source of pressurized gas;

b. a source of water in a tank;

c. a source of abrasive material;

d. a principal flow line in communication with the source of sand and pressurized air for delivering the sand under pressure within the principal flow line;

e. means for injecting a chemical inhibitor into the water tank;

f. first means along said principal flow line for introducing the water containing inhibitor into the sand flowing in the principal flow line, said means further comprising a principal flow chamber for accommodating the sand flow in said principal flow line;

g. first and second injection ports located in the wall of said chamber for allowing water containing chemical inhibitor and air to flow into said principal flow chamber through said first and second ports respectively; and h. means situated at points along the length of said principal flow line for providing an air pressure boost within the line, said means including an angulated orifice for introducing said air into said principal flow line under pressure in the direction of said main flow in said flow line.

* * * * *